United States Patent [19]

Baxendale

[11] Patent Number: 4,742,338

[45] Date of Patent: May 3, 1988

[54] INTRUDER ALARM SYSTEM

[75] Inventor: Roy Baxendale, Harpenden, England

[73] Assignee: GEC Avionics Limited, England

[21] Appl. No.: 864,811

[22] Filed: May 19, 1986

[30] Foreign Application Priority Data

May 17, 1985 [GB] United Kingdom ..... 8512489

[51] Int. Cl.[4] ..... G08B 13/00

[52] U.S. Cl. ..... 340/566; 340/65

[58] Field of Search ..... 340/566, 550, 65, 529, 340/530

[56] References Cited

U.S. PATENT DOCUMENTS

| | | | |
|---|---|---|---|
| 3,719,891 | 3/1973 | Lee | 340/566 |
| 3,879,720 | 4/1975 | Dusheck, Jr. | 367/136 |
| 4,223,304 | 9/1980 | Barowitz et al. | 340/566 |
| 4,306,228 | 12/1981 | Meyer | 340/566 |
| 4,307,387 | 12/1981 | Baxendale | 340/566 |
| 4,414,541 | 11/1983 | Ho | 340/566 |
| 4,479,113 | 10/1984 | McNeilly et al. | 340/566 |

*Primary Examiner*—Stewart J. Levy
*Assistant Examiner*—Hezron E. Williams
*Attorney, Agent, or Firm*—Kirschstein, Kirschstein, Ottinger & Israel

[57] ABSTRACT

An intruder alarm system of the type used to detect mechanical vibrations in a security fence or the like. Vibrations are assessed for alarm potential by detecting peak amplitudes against a dynamic vibration reference. A sufficient ratio between the two indicates an intrusion.

7 Claims, 3 Drawing Sheets

INTRUDER ALARM SYSTEM

BACKGROUND OF THE INVENTION

1. Field of the Invention

The present invention relates to intruder alarm systems of the type used to detect mechanical vibrations in a security fence or the like and to generate an alarm signal accordingly. A serious problem arises in such systems owing to the difficulty of discriminating between vibrations arising from interference with the security fence by a would-be intruder and vibrations arising naturally e.g. from wind.

2. Description of Related Art

Various discriminator circuits have been designed in order to distinguish between spurious and genuine intruder signals. One such circuit is disclosed in U.K. Pat. No. 2,045,494B and has been found to be effective. However there exists a continuing need for improved signal processing techniques based on an improved knowledge of the signal, so as to discriminate more reliably between processed signal patterns arising from intrusion attempts and those arising from environmental sources such as wind, birds and other small animals. In particular it has been difficult to detect intrusion attempts when high winds act on the security fence.

SUMMARY OF THE INVENTION

According to the present invention an intruder alarm system for processing signals representative of vibrations in a security fence or the like comprises first means including envelope detector means for generating a peak amplitude signal responsive to the peak amplitude of said vibrations, further means responsive to said vibrations for generating a dynamic reference signal, said reference signal having a slow rise time, comparator means arranged to compare said peak amplitude signal with said dynamic reference signal and to generate an output signal, and means responsive to said output signal for generating an alarm indication.

Preferably said comparator means generates said output signal whenever the ratio of the peak amplitude signal to the dynamic reference signal exceeds a predetermined value. Said predetermined value is preferably between 3 and 4.5 times the value (typically unity) of said ratio under conditions of constant amplitude of said vibrations, and is most preferably approximately 3.5 times the value of said ratio under constant amplitude conditions.

Preferably the level of the dynamic reference signal is prevented from exceeding the level of the peak amplitude signal. This may be achieved by providing a discharge path for the dynamic reference signal to a terminal which is at the potential of the peak amplitude signal.

Preferably said first means includes integrating means with a rapid rise time and a decay time which is longer than the natural decay time of vibrations in the security fence and is desirably greater than 0.3 seconds, e.g. between 0.3 and 1.0 seconds.

The means responsive to the output signal may include timing means responsive to the persistence of said output signal for a predetermined period between 300 and 500 milliseconds to generate the alarm indication.

Preferably the rise time of said dynamic reference signal is greater than 1 second and is desirably between 3 seconds and 10 seconds—e.g. approximately 5 seconds. Preferably the decay time of said dynamic reference signal is significantly shorter than its rise time. Preferably the decay time of said dynamic reference signal is approximately equal to the decay time of said peak amplitude signal.

Preferably a threshold signal is continuously applied to the output of said further means so as to tend to inhibit said output signal when the amplitude of said vibrations is low. Otherwise even a very slight disturbance of the fence might cause the ratio of the peak amplitude signal to the dynamic reference signal to exceed the predetermined value. Preferably said threshold signal is applied to the outputs of both said further means and said envelope detector means, so that the signals applied to the inputs of the comparator means tend to equalise when the amplitude of said vibrations is low.

Preferably further detector means are provided to detect large fluctuations in the signals representative of said vibrations (arising, for example, from attempts to destroy the security fence) and to trigger an alarm signal accordingly.

BRIEF DESCRIPTION OF THE DRAWINGS

One embodiment of the invention will now be described by way of example only, with reference to FIGS. 1 to 3 of the accompanying drawings, of which.

DETAILED DESCRIPTION OF THE PREFERRED EMBODIMENT

Figure 1:
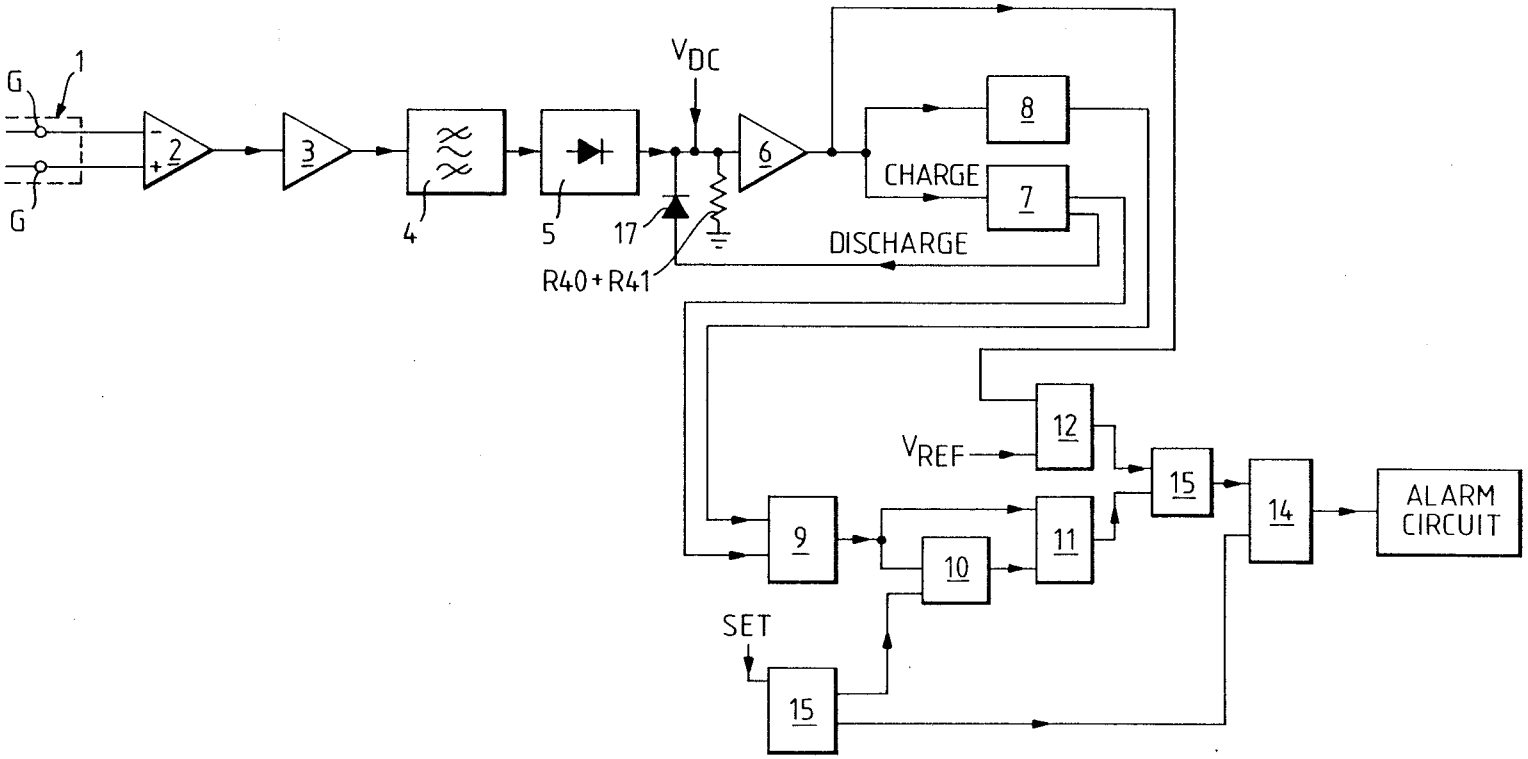
FIG. 1 is a block diagram of an intruder alarm system.

Referring to FIG. 1, the intruder alarm system shown comprises a security fence 1 to which a plurality of geophones G are coupled. The outputs of the geophones are fed in series to the input terminals of a broadband amplifier 2 (which has a gain of 40 dB) which feeds a variable gain amplifier 3. Variable gain amplifier 3 can be adjusted during commissioning to vary the overall gain of the signal processing chain so as to set the sensitivity of the intruder alarm system to an appropriate level. The output of amplifier 3 is fed to a $\frac{1}{3}$ octave bandpass filter 4(the centre frequency of this filter suitably being between 100 Hz and 250 Hz) and the filtered output is fed to an envelope detector 5 which feeds a D.C. output to the input of a unity-gain buffer 6. Envelope detector 5 incorporates an integrator with a fast rise time (e.g. of the order of a few milliseconds or less) and a slow decay time (i.e. significantly slower than the mechanical decay time of vibrations in the fence 1 and in this case 750 milliseconds). Thus the output of envelope detector 5 (and hence buffer 6) is essentially a unidirectional sawtooth waveform with rapidly rising leading edges and slowly decaying trailing edges. This waveform is fed directly via a resistive divider 8 and indirectly via a reference circuit 7 to respective inputs of a ratio comparator circuit 9. As will subsequently be described in detail with reference to FIG. 2, reference circuit 7 is driven by the peak amplitude signal and generates a unidirectional dynamic reference signal which has a slow rise time and a rapid decay time. Reference circuit 7 has a rise time of approximately 5 seconds and is provided with a unidirectional discharge path via an operational diode 17. This discharge path incorporates series-connected resistances R40 and R41 which are common to the discharge path of envelope detector 5 (and constitute the *only* resistance in its discharge path). Consequently the dynamic reference signal generated by reference circuit 7 decays at the same rate as the peak amplitude signal generated by envelope detector 5 whenever the peak amplitude signal falls to the level of the dynamic reference signal and continues to fall. This condition typically occurs at intervals of not more than a few seconds when the fence is under disturbance, so that the ratio of the peak amplitude signal to the dynamic reference signal is repeatedly returned towards unity irrespective of the general level of the peak amplitude signal. Voltage divider 8 and comparator circuit 9 are arranged so that comparator circuit 9 generates an output only when the instantaneous amplitude of the D.C. output signal from buffer 6 is at least 3.55 times as great as the instantaneous amplitude of the smoothed output from circuit 7 to the ratio comparator circuit 9. Hence the system as described thus far discriminates against signals from the geophones arising from continuous high winds acting on the fence 1, and also discriminates against varying signals arising from varying winds even though their amplitude builds up fairly quickly (i.e. over a period of a few seconds) because successive deep falls in the peak amplitude signal (which occur after each wind gust) reduce the duration of large ratios between the peak amplitude and dynamic reference signals during the build-up in wind. An equivalent build-up due to an intrusion attempt generally leads to a wider spacing between such deep falls in peak amplitude. Accordingly the duration of the output from comparator 9 is monitored in order to discriminate between these signal patterns. The output from comparator 9 is gated by a timer circuit 10 and a gate 11 so that gate 11 is activated only when the ratio of the input signal amplitudes at comparator 9 exceeds 3.55 for a period of between 300 and 500 milliseconds and, in this embodiment, 350 milliseconds. Wind-induced signals typically do not activate gate 11.

The output of gate 11 is fed to one input of a further gate 13. A further comparator circuit 12 feeds the other input of gate 13. Comparator circuit 12 and gate 13 preserve the integrity of the design against misguided use of too high a gain setting which could cause saturation of the envelope detector 5 in very high winds. Saturation of the envelope detector would tend to limit the ratio of the peak amplitude signal to the dynamic reference signal to too low a value. Accordingly comparator 12 is provided with a voltage reference $V_{REF}$ which corresponds to the onset of amplifier saturation, and gate 13 generates an output pulse (to trigger an alarm indication) if *either* of its inputs indicates a disturbance of the fence. A counter 14 is reset by this output pulse and generates an alarm signal for a pre-set period as a result. The duration of the alarm signal is governed by a timing oscillator 15 which also governs the timing circuit 10, as will subsequently be described with reference to FIG. 2.

Figure 2:
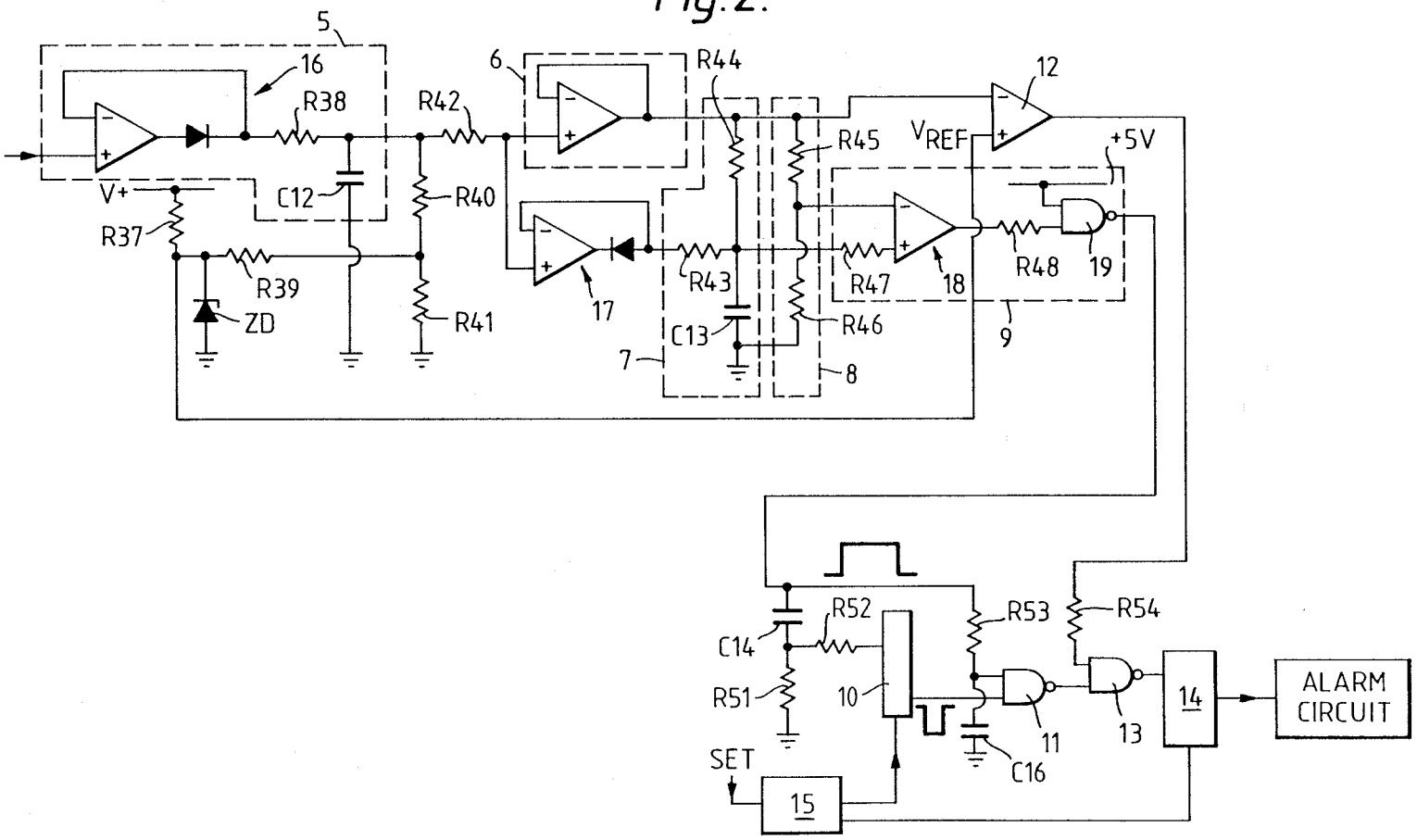
FIG. 2 is a circuit diagram showing in more detail part of the intruder alarm system of FIG. 1, FIG. 3(*a*) shows typical waveforms of the peak amplitude signal and dynamic reference signal generated in the circuit of FIG. 2, FIG. 3(*b*) shows the corresponding ratio of these signals, and FIG. 3(*c*) shows the corresponding "event" and "alarm" signals which occur in the circuit of FIG. 2 as a result.

Referring now to FIG. 2, envelope detector 5 incorporates an operational diode 16 (which acts as an ideal diode with no forward voltage drop) and an integrator comprising a 150 Ω resistor R38 and a 3.3 μF integrating capacitor C12. Series-connected resistances R40 and R41 provide a high resistance (220kΩ) discharge path for capacitor C12. Consequently the output of envelope detector 5 is a D.C. voltage corresponding to the peak amplitude of the signals from bandpass filter 4. with a decay time of approximately 750 milliseconds. This D.C. voltage is fed via a resistance R42 to a unity-gain buffer amplifier 6 and thence in parallel to averaging circuit 7 and voltage divider circuit 8. Averaging circuit 7 consists of a 3.3 μF capacitor C13 which is charged via a high (1.5MΩ) resistance R44 and (when the output of envelope detector 5 falls to the level of the dynamic reference signal from circuit 7) discharges through a low-resistance discharge path formed by a resistor R43, an operational diode 17 (which acts as a diode with no forward voltage drop) and resistors R42, R40 and R41. The effective resistance of this discharge path is essentially determined by R40 and R41 and is therefore the same as the resistance of the discharge path of envelope detector 5, namely 220kΩ. Consequently circuit 7 has a rise time of 5 seconds and (when the peak amplitude signal has fallen to the level of the dynamic reference signal) a decay time of approximately 750 milliseconds. Its output at the common terminal of R44 and C13 constitutes a reference voltage which is the first of the two signals compared in comparator circuit 9. Voltage divider 8 is composed of two resistors R45 and R46. The resistance ratio (R45+R46): R46 is set at 3.55. The instantaneous output of averaging circuit 7 is fed through a protective resistance R47 and compared with the output of voltage dividing circuit 8 by a differential amplifier 18 which is included in comparator circuit 9. Differential amplifier 18 generates a negative output whenever the output of voltage divider 8 (which corresponds to the waveform across integrating capacitor C12) exceeds the threshold voltage (which corresponds to the waveform across capacitor C13) by a factor of 3.55 or more. This negative output, fed through protective resistor R48 to one input of a NAND gate 19 (the other input being maintained at +5 V) causes NAND gate 19 to generate a positive EVENT pulse which persists as long as the critical 3.55 ratio is exceeded. The EVENT Pulse is differentiated by a differentiating capacitor C14 and resistor R51 and the resulting sharp pulse fed to a timing circuit 10 via a protective resistor R52. This sharp pulse triggers a negative reference pulse of known duration from the output of timing circuit 10 which is fed to one input of a NAND gate 11. Resistor R53 and capacitor C16 slow down the rise time of the EVENT pulse into one input of NAND gate 11, so that this input is still at logic low level when the negative reference pulse from timer 10 causes the other input of NAND gate 11 to fall to logic low level. The output of the gate therefore remains high during this transition. The input to gate 11 from counter 10 rises to logic high level at the end of the reference pulse, and if the EVENT Pulse still persists (i.e. the EVENT Pulse is longer than the reference pulse) then its output goes low for the remainder of the EVENT pulse. This active low output causes the output of a subsequent NAND gate 13 to be at a logic high level (irrespective of the logic state of the other input to gate 13) and counter circuit 14 triggers an alarm signal for a specified duration as a result. An oscillator 15 feeds reference signals to timer 10 and counter 14 which control the duration of the reference pulse and the duration of the alarm signal. The former is adjustable by a SET input to oscillator 15 and is typically 350 milliseconds.

In order to detect drastic disturbances of the security fence 1, the output of buffer amplifier 6 is fed to the inverting input of a differential amplifier 12, and compared with a reference voltage $V_{REF}$ at the non-inverting input. $V_{REF}$ is set at 6.8 volts by a zerer diode ZD which is connected via a resistor R37 to a supply rail V+. If the peak amplitude of the signals from envelope detector 5 exceed 6.8 volts, the output of differential amplifier 12 goes negative and feeds a logic low signal to one input of NAND gate 11 via a resistor R54, causing an alarm indication as a result. Thus NAND gate 13 acts as an OR gate.

In order to prevent the critical 3.55 ratio of input levels at comparator circuit 9 from being exceeded by very small signals when the threshold voltage generated by averaging circuit 7 is low, a low level D.C. voltage (approximately 100 mV) is applied to integrating capacitor C12 and capacitor C13 from the supply rail V+via a resistor R40 from a potential divider, consisting of resistors R41 and R39 across zener diode ZD. Thus the voltages across these capacitors (and hence the inputs to comparator circuit 9) tend to equalise under quiet conditions.

Figure 3A:
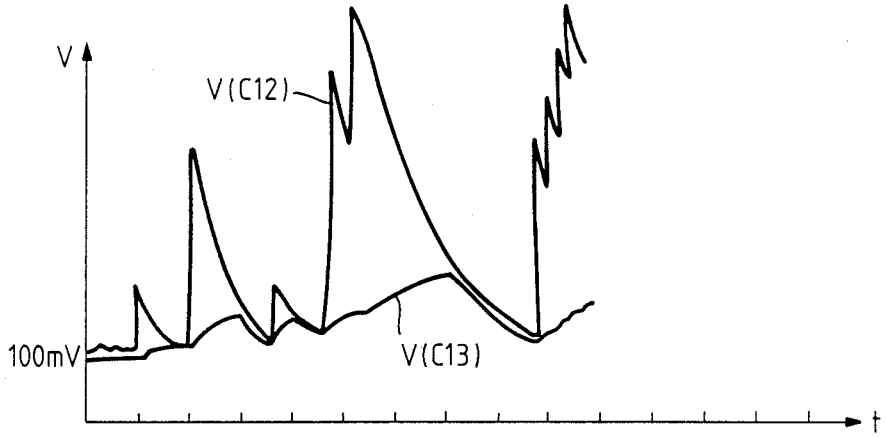
Figure 3B:
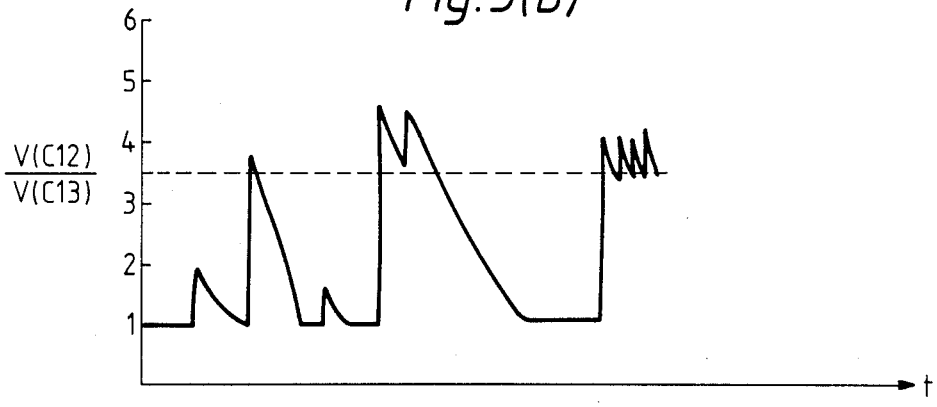
Figure 3C:
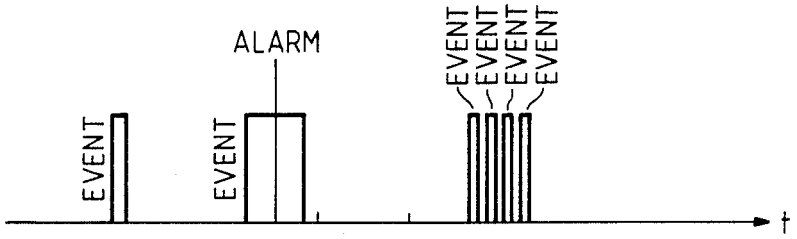

FIG. 3 shows the behaviour of the discriminator circuit arrangement of FIG. 2 in response to nine successive disturbances at the security fence 1.

It is assumed that there is initially little or no wind. Consequently the voltage $V_{(C12)}$ across capacitor C12 (which corresponds to the input to comparator circuit 9 from voltage divider 8) and the voltage $V_{(C13)}$ across capacitor C13 (which corresponds to the input to comparator circuit 9 from circuit 7) are both maintained at approximately 100 mV initially (FIG. 3(*a*)). Subsequently a sudden minor disturbance causes a sudden jump in $V_{(C12)}$, which gradually decays while $V_{(C13)}$ slowly rises to meet $V_{(C12)}$. No EVENT pulse is generated because the common 100 mV quiescent voltage prevents the 3.55 ratio (indicated by a dashed line in FIG. 3(*b*)) from being exceeded. Subsequently a larger disturbance (due e.g. to a sudden gust of wind) causes $V_{(C12)}$ to rise considerably. Consequently the ratio $V_{(C12)}$:$V_{(C13)}$ briefly rises past 3.55 and a correspondingly brief EVENT Pulse is generated (FIG. 3(*c*)). The EVENT pulse persists for less than 350 ms and therefore no alarm signal is generated. $V_{(C12)}$ and $V_{(C13)}$ decay at the same rate through their common discharge path. A subsequent minor gust of wind causes a third peak in $V_{(C12)}$ but this occurs too long after the previous disturbance to affect the ratio $V_{(C12)}$:$V_{(C13)}$ significantly. Therefore neither an EVENT pulse nor an alarm indication results. Next however two successive disturbances occur as a result of an attempt to climb the fence, and these sustain an EVENT pulse for sufficiently long to trigger an alarm signal, as shown in FIG. 3(*c*). Finally a wind build up causes a rapid succession of four peaks in V(C12) (corresponding to four successive gusts) and these cause four correspondingly short event pulses, which are however of insufficient duration to trigger an alarm signal.

What is claimed is:

1. An intruder alarm system comprising: at least one electromechanical transducer for providing electric signals having an amplitude in response to vibrations incident thereon; envelope detector means for deriving a unidirectional waveform signal representing the amplitude of said electric signals; integrating circuit means for deriving a dynamic reference signal from said unidirectional waveform signal; comparator means for comparing said unidirectional waveform signal with said dynamic reference signal; means responsive to an output signal from said comparator means for generating an alarm indication; and means for providing a discharge path between said integrating circuit means and an output of said envelope detector means for preventing said dynamic reference signal from exceeding said unidirectional waveform signal.

2. The intruder alarm system according to claim 1, wherein said comparator means is operative for generating said output signal whenever said unidirectional waveform signal compared to said dynamic reference signal form a ratio which exceeds a predetermined value.

3. The intruder alarm system according to claim 2, wherein said predetermined value is between 3 and 4.5.

4. The intruder alarm system according to claim 3, wherein said predetermined value is approximately 3.5.

5. The intruder alarm system according to claim 1, wherein said envelope detector means includes integrating means having a rapid rise time and a decay time which is between 0.3 and 1.0 seconds.

6. The intruder alarm system according to claim 2, and means for applying a low-level d.c. voltage to an output of said envelope detector means so that said signals applied to said comparator means tend to equalize when the amplitude of said vibrations is low.

7. The intruder alarm system according to claim 1, and further detector means for detecting large fluctuations in the electric signals provided by said transducer, and for triggering an alarm signal accordingly.

* * * * *